US006341979B1

(12) United States Patent
Yamamoto

(10) Patent No.: US 6,341,979 B1
(45) Date of Patent: Jan. 29, 2002

(54) ELECTRICAL CONNECTOR

(75) Inventor: Yasuhiro Yamamoto, San Francisco, CA (US)

(73) Assignee: Monster Cable Products, Inc., Brisbane, CA (US)

( * ) Notice: Subject to any disclaimer, the term of this patent is extended or adjusted under 35 U.S.C. 154(b) by 0 days.

(21) Appl. No.: 09/755,661

(22) Filed: Jan. 4, 2001

(51) Int. Cl.[7] ..... H01R 4/24
(52) U.S. Cl. ..... 439/415; 439/433; 439/434
(58) Field of Search ..... 439/447, 461, 439/879, 415, 416, 431–434

(56) References Cited

U.S. PATENT DOCUMENTS 2,792,560 A * 5/1957 Bollmeier ..... 439/245
3,205,472 A * 9/1965 Shannon ..... 439/764
3,210,720 A * 10/1965 Harris, Jr. ..... 339/149
3,517,112 A * 6/1970 Wahl ..... 439/427
3,905,672 A * 9/1975 Anhalt et al. ..... 339/103 R
4,454,376 A * 6/1984 Holder et al. ..... 174/87
5,083,935 A * 1/1992 Herman ..... 439/433
5,418,331 A * 5/1995 Delalle ..... 174/87
5,531,618 A * 7/1996 Market ..... 439/840
5,975,939 A * 11/1999 Market ..... 439/415
6,183,285 B1 * 2/2001 Szu ..... 439/327

* cited by examiner

*Primary Examiner*—Paula Bradley
*Assistant Examiner*—Ann McCamey
(74) *Attorney, Agent, or Firm*—Lariviere, Grubman & Payne, LLP

(57) ABSTRACT

An electrical connector apparatus and method utilizing an elongate electrically conducting ferrule (20) having a contact (24) on one end and a hollow conical threaded portion (22) for receiving a wire on the other end, and a color coded insulating boot (10) threaded over the ferrule to cover all but the contact. The electrical wire is wrapped around threaded portion (22) which is then tightened into boot (10), thereby securing the wire to the ferrule (20). Ferrule (20) can then be electrically connected by use of contact (24) to a device for receiving power.

20 Claims, 2 Drawing Sheets

ELECTRICAL CONNECTOR

FIELD OF THE INVENTION

The present invention relates generally to electrical connectors and, more specifically, to connectors for smaller electrical wires such as used for lower voltage, lower current electrical systems.

BACKGROUND OF THE INVENTION

Electrical connections for removably connecting electrical wires to devices to be supplied with lower voltage (i.e., less than 240 volts) lower current (i.e., less than 30 amperes) electricity are conventionally made by one of two methods. The first method involves bending the wire around a threaded post and securing the wire to the post by tightening-down a nut onto the wire. A common variation of this method is replacing the post with a bolt, forming the nut as a portion of the device to which the wire is to be connected, and tightening the bolt into the nut portion, thereby clamping the wire tightly (e.g., connecting a bulb whose lower portion comprises a "wire" to an incandescent lamp socket). However, a major disadvantage of this connection method is that the wires are susceptible to breakage in the event of disconnection/reconnection. The second method involves fastening the wire to an intermediary device, which is then, in turn, connected to the subject device (e.g., soldering or crimping the wire to a spade or ring lug, which is then, in turn, fastened to the post or bolt, as described with respect to the first method). Another variation is soldering or crimping the wire to a spade connector which is then, in turn, inserted into a socket, the socket being electrically connected to the device for receiving power (e.g., plug connections used in automobile wiring harnesses). However, a disadvantage of this method is that an extra component, a tool, such as a soldering iron or crimper, is required to secure the wire to the intermediary device. Therefore, a need exists for a method and apparatus of quickly and efficiently connecting and disconnecting a wire to a peripheral device while maintaining the wire's integrity.

BRIEF SUMMARY OF THE INVENTION

Accordingly, the present invention provides an apparatus and method for quickly and efficiently connecting and disconnecting a wire to a peripheral device using a minimal number of components while preserving the wire's integrity. The present invention comprises a ferrule having two ends, a fork or ring lug being disposed at one end and a hollow truncated conical threaded portion around which the strands of an electrical wire are wound disposed at the other end. The threaded portion is then hand-tightened into a matched strain relief boot which secures the wire to the ferrule. The ferrule can then be removably connected to the peripheral device for making and breaking an electrical coupling. The present invention provides a reliable connector for applications where the electrical connection requires frequent disassembly/reassembly, such as in wiring of portable audio equipment.

BRIEF DESCRIPTION OF THE DRAWINGS

For a fuller understanding of the present invention, reference is below made to the accompanying drawings in the following section entitled Detailed Description of the Invention.

Reference numbers refer to the same or equivalent parts of the present invention throughout the several figures of the drawings.

DETAILED DESCRIPTION OF THE INVENTION

Figure 1:
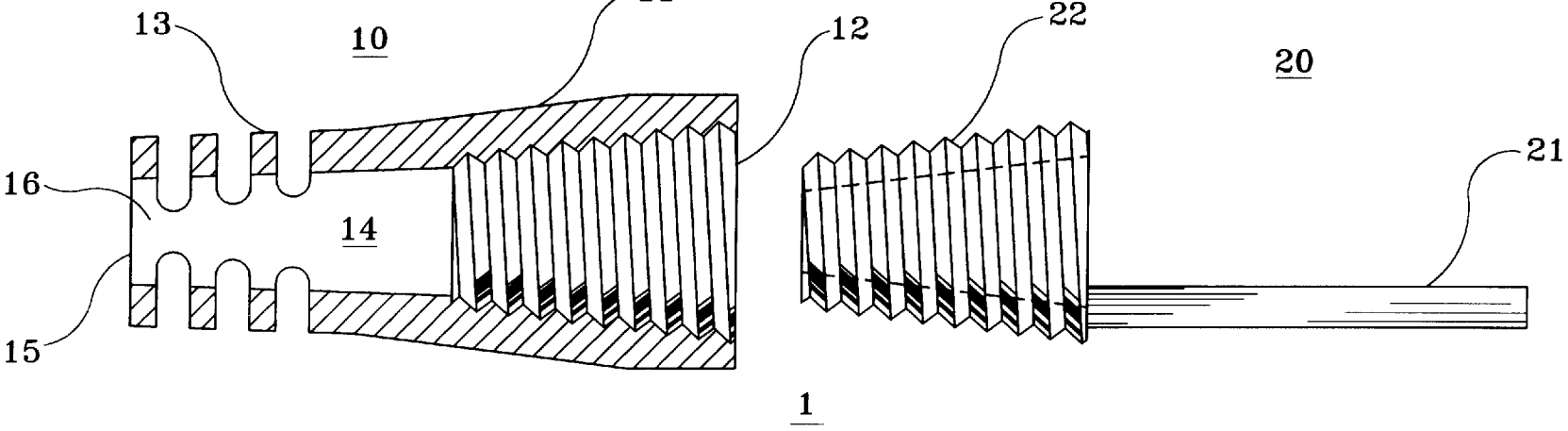
FIG. 1 is a longitudinal cross section of a pair of mating components, in accordance with the present invention.

Referring to FIG. 1, a pair of mating components of connector 1 are shown in longitudinal cross section. A strain relief boot 10 (i.e., a female component of the connector 1) is configured to receive a ferrule 20 (i.e., a male component of the connector 1) and a suitable electrical wire (not shown). The boot 10 comprises a body 11 constructed from a suitable insulating material, such as a moldable plastic. The body 11 can be color coded in either solid or patterned colors to aid in identifying particular electrical wires. The boot 10 has a threaded portion 12 configured to receive a threaded portion 22 of ferrule 20, below described, and a cavity 14 configured to receive an insulated electrical wire through an open end 15 having a given diameter. The threaded portions 12, 22 are optionally tapered (e.g., conical or frusto-conical). Gripper lugs 13 are annular ridges around body 11. The gripper lugs 13 provide a degree of flexibility and purchase for positioning and holding the body 11. An optional throat 16 has a restricted diameter (i.e., dimensioned smaller than the given diameter of the open end 15) in cavity 14 which is sized to snugly receive a specified wire diameter. Thus, the boot 10 is constructed in a variety of sizes, adapted for use on specific wire gauges, such as standard wire sizes. The throat 16 provides a measure of grip on an insulated jacket of the wire, thereby absorbing some of any subsequent longitudinal strain or bending stress on the wire.

Still referring to FIG. 1, the ferrule 20 is shown in longitudinal cross section. The ferrule 20 is constructed of an electrically conducting material such as copper, brass, aluminum, or the like. In some applications, such as connectors for audio equipment, the ferrule 20 could be constructed of a non-conducting resilient base material plated with an electrically conducting material. In other applications, constructing the ferrule 20 of an electrically conducting material plated with an electrically conducting non-oxidizing material such as gold, platinum, or the like may be desirable. The ferrule 20 is preferably constructed with a flat-end blade 21, and a tapered truncated hollow cone-end threaded portion 22. In use, the subject wire is first inserted through the open end 15, the throat 16, and the cavity 14 of the boot 10. The length of the insulating jacket of the wire is then removed from the end of the wire, thereby exposing a length of the wire, such length being related to the approximate circumference of the threaded portion 22 and also being preferably sufficient to wrap two to three times around the threaded portion 22. The exposed wire, preferably being stranded wire, is then wound around the threaded portion 22. The threaded portion 22 of the ferrule 20 is then hand-tightened into the threaded portion 12 of the boot 10, thus securing the exposed wire onto the ferrule 20. The blade 21 of the ferrule 20 is then ready for connection to the device to receive electricity. While the present invention is directed at manual connection of a wire to a contact, such process could also be automated and performed by a machine.

Figure 2:
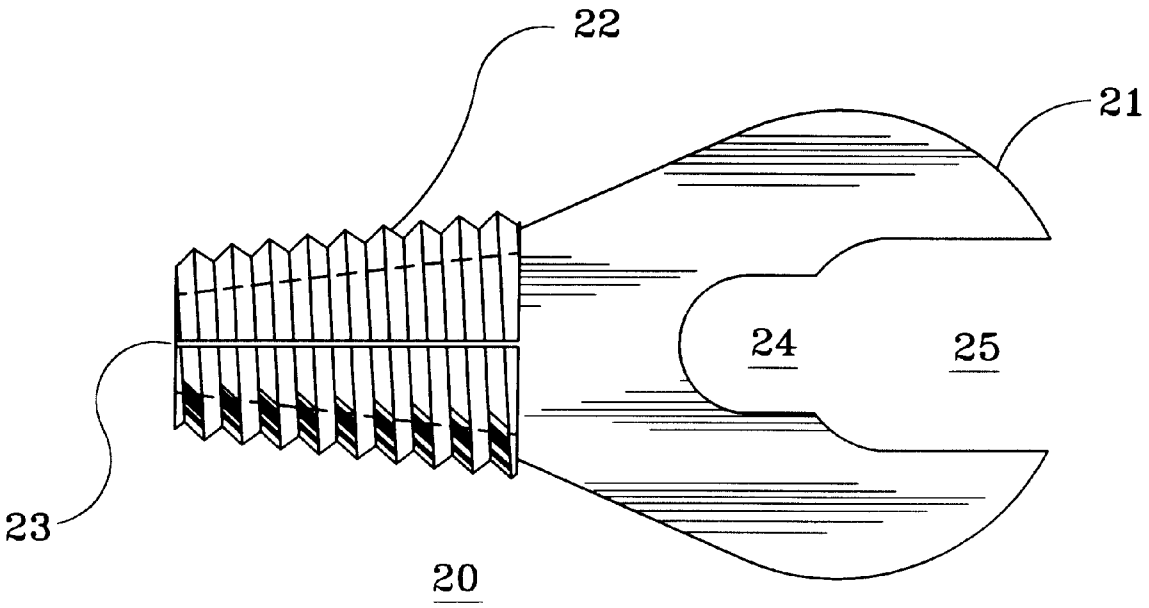
FIG. 2 is a plan view of a ferrule (male component), in accordance with the present invention.

Referring now to FIG. 2, the ferrule 20 is shown in plan view. The blade 21 is preferably configured in a flat arcuate fork, as shown, forming a contact 24 with an opening 25. In this configuration, the blade 21 can be detachably inserted between a bolt head and a nut without disassembling the bolt from the nut. In a first embodiment, the contact 24 can be formed as a flat ring by eliminating opening 25. In a second embodiment, the blade 21 could be formed as a solid pin for detachably insertion into a suitable socket. In a third embodiment, the blade 21 could be formed as a solid flat spade for inserting into a suitable socket. In any of possible embodiment, the contact 24 is removably secured to the subject device for receiving power, thereby allowing for frequent connect-disconnect cycles without loosening the good wire-ferrule connection achieved at the threaded portion 22 of the ferrule 20.

Figure 3:
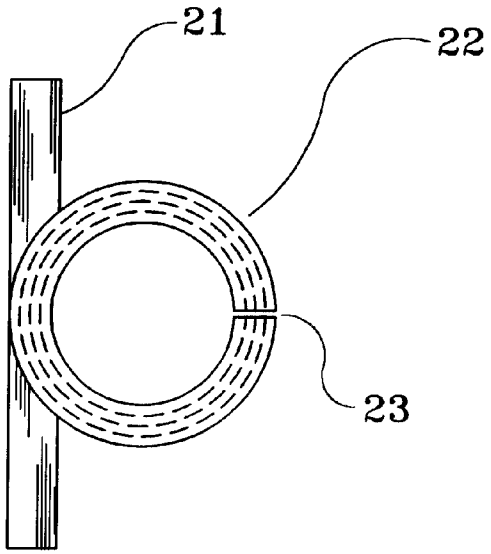
FIG. 3 is an end view of the ferrule, in accordance with the present invention.

Referring to FIGS. 2 and 3, a compression slot 23 is illustrated. The threaded portion 22 of the ferrule 20 is hand-tightened into the threaded portion 12 of the boot 10. In order for the ferrule 20 and the boot 10 to mate properly, the dimensions of the threaded portion 12 must be approximately the same as that of the threaded portion 22 (i.e., little or no tolerance). When the subject wire is wound around the threaded portion 22, a combinational diameter of the subject wire as combined with the threaded portion 22 is greater than the diameter of the threaded portion 22 alone. The combinational diameter depends on the wire gauge and the number of wraps made. In order for the threaded portion 22 to mate efficiently and properly with the threaded portion 12, the combinational diameter is readjusted to approximately the original diameter of the threaded portion 22. The compression slot 23 facilitates the threaded portion 22 being compressed, independent of the wire gauge and the number of wraps by allowing itself to close slightly as the threaded portion 22 is hand-tightened into the threaded portion 12, thereby effecting a compression-fit (i.e., an interference-fit) between the portions 12, 22 using the wire, and, thus, forming a secure tight electrical connection between the subject wire and the ferrule 20. In addition, the wire may experience a nominal deformation into the compression slot 23 during hand-tightening which furthers the interference-fit and improves electrical contact between the wire and the ferrule 20.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims. Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, it should be readily apparent to those of ordinary skill in the art that various changes and modifications in form, semiconductor material, and fabrication material detail may be made without departing from the spirit and scope of the inventions as set forth in the appended claims. No claim herein is to be construed under the provisions of 35 U.S.C. 112, sixth paragraph, unless the element is expressly recited using the phrase "means for."

What is claimed:

1. An electrical connector comprising:

means for electrically conducting and connecting an electrical wire to a peripheral device; and means for covering and insulating a portion of the electrically conducting and connecting means, the electrically conducting and connecting means being removably inserted into the covering and insulating means.

2. An electrical connector, as recited in claim 1, wherein the covering and insulating means is colored.

3. An electrical connector, as recited in claim 1, wherein the electrically conducting and connecting means comprises an elongated ferrule having a first end and a second end, the first end comprising a contact, the second end comprising a ferrule threaded portion for receiving a wire, and wherein the covering and insulating means comprises a stress/strain relieving boot for covering all but the contact of the ferrule, the boot having a corresponding boot threaded portion for receiving the ferrule threaded portion.

4. An electrical connector, as recited in claim 3, wherein the contact is configured in a shape selected from a group consisting essentially of an open arcuate fork, a closed ring, a flat spade, and a round pin.

5. An electrical connector, as recited in claim 3, wherein the ferrule threaded portion is configured in a shape selected from a group consisting essentially of a solid conical shape, a solid frusto-conical shape, a hollow conical shape, and a hollow frusto-conical shape.

6. An electrical connector, as recited in claim 3, wherein the ferrule threaded portion comprises a compression slot for facilitating a compression-fit between the ferrule and the boot.

7. An electrical connector, as recited in claim 1, wherein the electrically conducting and connecting means comprises a material selected from a group consisting essentially of an electrically conducting material, an electrically insulating base material plated with an electrically conducting material, and an electrically conducting material plated with a non-oxidizing electrically conducting material.

8. An electrical connector, as recited in claim 7, wherein the electrically conducting material comprises at least one material selected from a group consisting essentially of copper, brass, and aluminum.

9. An electrical connector, as recited in claim 7, wherein the electrically insulating base material comprises resilient insulating material.

10. An electrical connector, as recited in claim 7, wherein the non-oxidizing electrically conducting material comprises at least one material selected from a group consisting essentially of gold and platinum.

11. A method for providing electrical connection comprising:

providing means for electrically conducting and connecting an electrical wire to a peripheral device;

providing means for covering and insulating a portion of the electrically conducting and connecting means; and removably inserting the electrically conducting and connecting means into the covering and insulating means.

12. A method, as recited in claim 11, wherein the covering and insulating means is colored.

13. A method, as recited in claim 11, wherein the electrically conducting and connecting means comprises an elongated ferrule having a first end and a second end, the first end comprising a contact, the second end comprising a ferrule threaded portion for receiving a wire, and wherein the covering and insulating means comprises a stress/strain relieving boot for covering all but the contact of the ferrule, the boot having a corresponding boot threaded portion for receiving the ferrule threaded portion.

14. A method, as recited in claim 13, wherein the contact is configured in a shape selected from a group consisting essentially of an open arcuate fork, a closed ring, a flat spade, and a round pin.

15. A method, as recited in claim 13, wherein the ferrule threaded portion is configured in a shape selected from a group consisting essentially of a solid conical shape, a solid frusto-conical shape, a hollow conical shape, and a hollow frusto-conical shape.

16. A method, as recited in claim 13, wherein the ferrule threaded portion comprises a compression slot for facilitating a compression-fit between the ferrule and the boot.

17. A method, as recited in claim 11, wherein the electrically conducting and connecting means comprises a material selected from a group consisting essentially of an electrically conducting material, an electrically insulating base material plated with an electrically conducting material, and an electrically conducting material plated with a non-oxidizing electrically conducting material.

18. A method, as recited in claim 17, wherein the electrically conducting material comprises at least one material selected from a group consisting essentially of copper, brass, and aluminum.

19. A method, as recited in claim 17, wherein the electrically insulating base material comprises resilient insulating material.

20. A method, as recited in claim 17, wherein the non-oxidizing electrically conducting material comprises at least one material selected from a group consisting essentially of gold and platinum.

* * * * *